United States Patent [19]

Browning

[11] 4,249,445

[45] Feb. 10, 1981

[54] FOOD SLICING APPARATUS

[76] Inventor: Richard J. Browning, 2440 Jeppesen Acres, Eugene, Oreg. 97401

[21] Appl. No.: 53,963

[22] Filed: Jul. 2, 1979

[51] Int. Cl.[3] ..... B26D 4/42

[52] U.S. Cl. ..... 83/762; 83/454; 83/464; 83/467 R

[58] Field of Search ..... 83/761, 762, 763, 764, 83/454, 464, 465, 467 R; 269/288, 291, 292, 295, 87.2

[56] References Cited

U.S. PATENT DOCUMENTS

| | | | |
|---|---|---|---|
| 1,131,333 | 3/1915 | Coon | 83/762 |
| 2,474,171 | 6/1949 | Swanson | 83/762 |
| 4,125,046 | 11/1978 | Kroth | 83/762 X |

FOREIGN PATENT DOCUMENTS

| | | | |
|---|---|---|---|
| 104001 | 7/1899 | Fed. Rep. of Germany | 83/762 |

*Primary Examiner*—J. M. Meister
*Attorney, Agent, or Firm*—Kolisch, Hartwell & Dickinson

[57] ABSTRACT

Apparatus usable in slicing food. The apparatus includes a cutting board, and a pair of laterally spaced side walls having formed therein a pair of laterally spaced guide slots for guiding a cutting blade in a planar region which extends to the surface of the cutting board and is perpendicular thereto. A support member having a pair of opposed parallel planar faces is mountable on the board in either of two orientations wherein one or the other of the faces confronts the planar region and is spaced therefrom a distance which is different in each orientation. A brace supportable on the board at an inclined position engages one side of a food article to be sliced, to clamp the same between the brace and the selected face of the support member.

4 Claims, 4 Drawing Figures

FOOD SLICING APPARATUS

BACKGROUND AND SUMMARY OF THE INVENTION

The present invention relates to apparatus for slicing food, and in particular to apparatus for slicing bread, rolls, and the like.

One object of the present invention is to provide apparatus for slicing rolls or the like, wherein the food article to be sliced may be anchored during slicing.

Another object is to provide such apparatus which may also be adapted for slicing a loaf of bread or the like.

A further object is to provide such apparatus usable in slicing food articles to produce different selected slice thicknesses.

Yet another object of the invention is to provide such apparatus which is durable and attractive in appearance.

The apparatus of the invention includes a cutting board having attached thereto a pair of laterally spaced side walls. Formed in these walls are two laterally spaced guide slots for guiding a cutting blade in a planar region which extends to the surface of the cutting board, and is substantially perpendicular thereto. A support member having a pair of opposed parallel planar faces is removably mounted on the board in either of two orientations wherein one or the other of the two faces confronts the planar region and is spaced therefrom a distance which is different in each orientation. A brace mountable on the board at an inclined position engages one side of an article to be sliced, to anchor the same between the brace and the selected face of the support member.

These and other objects and features of the present invention will become more fully apparent when considered with the following detailed description of a preferred embodiment of the invention and the accompanying drawings, wherein.

DETAILED DESCRIPTION OF A PREFERRED EMBODIMENT OF THE INVENTION

Figure 1:
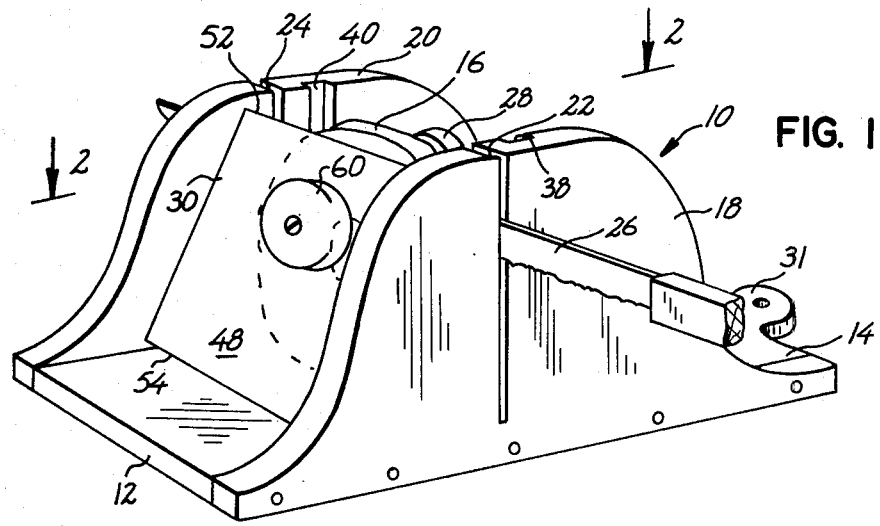
FIG. 1 is a perspective view of the present invention, shown here being used in slicing a bagel.
Figure 2:
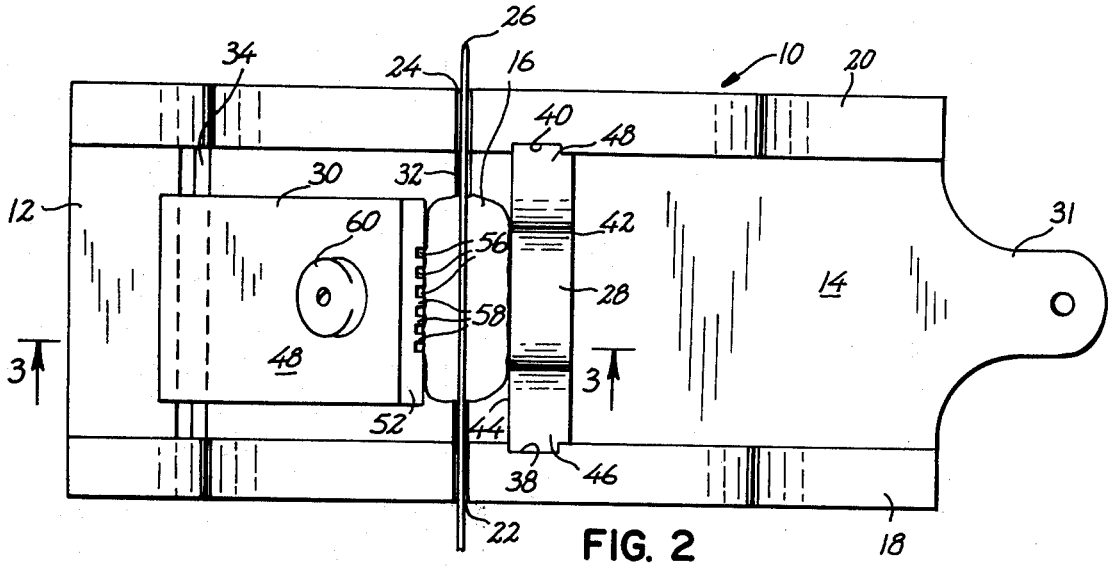
FIG. 2 is a plan view, on a larger scale taken generally along line 2—2 in FIG. 1.
Figure 3:
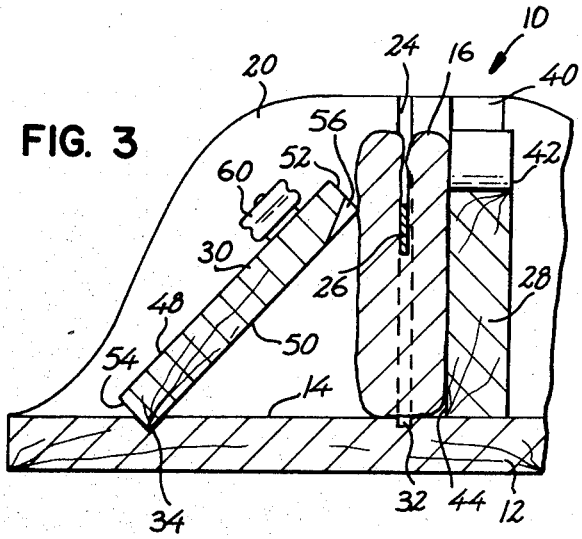
FIG. 3 is a sectional view, taken generally along line 3—3 in FIG. 2.

Looking now at the figures, and first at FIGS. 1-3, there is shown generally at 10, slicing apparatus usable in slicing food articles such as bagels, rolls, bread and the like. Apparatus 10 generally includes an elongate cutting board 12 having an upper surface 14 on which an article to be sliced, such as the bagel indicated at 16, is supported. A pair of laterally spaced side walls 18, 20 attached to opposed edges of board 12, provide a pair of upright, laterally spaced guide slots 22, 24 for guiding a cutting blade, such as knife blade 26, in a planar region. A support member 28 mountable between walls 18, 20 provides a surface against which one side of a food article, such as bagel 16, is supported at a selected distance from the just-described planar region. A brace 30 is adapted to be supported on the board, at an inclined angle relative thereto, with the upper portion of the brace contacting a portion of the other side of the food article.

Considering now details of the invention, board 12 is formed preferably of solid or ply hardwood conventionally used in cutting boards, and is so dimensioned that common sizes of breads, rolls, and the like may be received between walls 18, 20. A laterally extending groove 32 (FIGS. 2-4) formed in board 12, at a longitudinal position thereon coincident with the above-mentioned planar region, extends such planar region somewhat below the surface of the board, as can be appreciated with reference to FIG. 3. Also formed in board 12 is notch means including a laterally extending, V-shaped notch 34 longitudinally spaced from groove 32, in the direction opposite member 28, for releasably holding the lower edge of brace 30 thereat. Board 12 also provides a handle 31 from which the apparatus may be hung during storage.

Walls 18, 20, which also may be formed of hardwood, are attached conventionally, adjacent their lower edges in the figures, to opposed side edges of board 12. Slots 22, 24 formed in walls 18, 20, respectively, are dimensioned to receive therein knife blades of conventional widths. Each slot extends from the upper edge of the associated wall to the level of the lowermost face of groove 32. The above-mentioned planar region, which is defined by slots 22, 24, and groove 32, is perpendicular to the plane containing surface 14, and extends from the top of walls 18, 20, to a lower edge somewhat below surface 14. A pair of upright, laterally spaced grooves 38, 40 are formed in the inwardly facing sides of walls 18, 20, respectively, for mounting member 28 therebetween. Grooves 38, 40 are parallel to, and spaced an equal distance from associated slots 22, 24, respectively.

Support member 28, which also may be formed of a block of hardwood, includes a pair of substantially parallel planar faces 42, 44. The support member is notched, along its upright edges adjacent face 42, forming a pair of laterally spaced tongues 46, 48 (FIGS. 2 and 4) which are dimensioned to be received slidingly within grooves 38, 40. According to an important feature of the present invention, tongues 46, 48 are longitudinally asymmetric with respect to faces 42, 44. Accordingly, member 28 may be mounted selectively between walls 18, 20 at a first orientation, shown in FIGS. 1-3, wherein face 44 confronts the above-described planar region, and is spaced a defined slice-thickness distance therefrom, and in a second orientation, shown in FIG. 4, wherein face 42 confronts the planar region, and is spaced therefrom a second, lesser slice-thickness distance. In both of the just-mentioned orientations, the planes containing faces 42, 44 are parallel to the planar region. Grooves 38, 40 in walls 18, 20, respectively, and the support member's tongues 46, 48 which are received therein, are also referred to herebelow as means for mounting member 28 releasably on board 12, at one location therealong in such first and second orientations.

Brace 30, which also may be formed of a block of hardwood, includes upper and lower faces 48, 50, respectively, and a pair of opposed upper and lower end edges 52, 54, respectively. As seen best in FIG. 3, the planes containing edges 52, 54 are parallel and substantially perpendicular to the planes containing faces 48, 50. A plurality of triangular shaped notches, such as notches 56 (FIGS. 2 and 3), are formed between edge 52 and face 50, defining therebetween a plurality of teeth, such as teeth 58, for a purpose to be described. Brace 30 further includes a handle 60 attached to face 48, adjacent edge 52. With particular reference to FIG. 3, it can be appreciated that with edge 54 supported within notch 34, brace 30 may be pivoted to an inclined angle wherein edge 52, and in particular teeth 58 formed therein, contact the other side of an article, such as bagel 16, whose one side is supported against member 28. With the brace positioned as seen in FIGS. 1–3, it can be appreciated further that application of a downward force on the brace, by manual application of force to handle 60, causes teeth 58 to bear into such other article surface, thus anchoring the article between the brace and the support member. Teeth 58 are also referred to herebelow as means for anchoring a side of an article to be sliced to stabilize the article during slicing.

Figure 4:
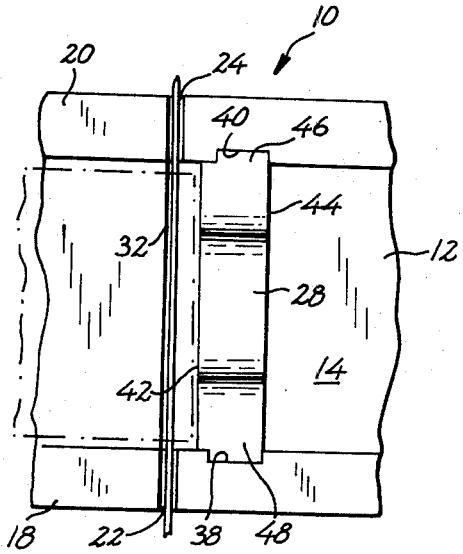
FIG. 4 is a fragmentary plan view similar to FIG. 2, but with the device shown prepared for cutting a different slice thickness.

When the apparatus is to be used as a bread slicer, brace 30 is removed from the board, and the loaf of bread to be sliced (indicated by dash-dot lines in FIG. 4) is inserted between walls 18, 20, at the left portion thereof in the figures. Member 28 is then placed in one of its two above-described orientations, wherein one of faces 42, 44 confronts the board's planar cutting region, at one of two selected distances therefrom. The right end of the loaf in FIG. 4, is then moved against the selected face of member 28, and the loaf is sliced.

To employ the apparatus as a roll, bagel, or bun slicer, member 28 is place at one of its two above-described orientations, thus establishing a desired slice-thickness and one side of the food article is placed against the face of member 28 which confronts the board's planar cutting region. Brace 30 is then placed at its inclined position with brace edge 54 supported in notch 34 and edge 52—and in particular, the teeth 58 thereof—contacting the other side of the article. The person operating the apparatus then places one of his hands on handle 60 and applies a slight downward pressure to this handle, thus to anchor the article to be sliced firmly between the brace and the support member. With the article so anchored the user then performs the slicing operation, with knife blade 26 being guided between the two guide slots.

A particular advantage of the present apparatus, which can be appreciated from the foregoing, is that the user, in anchoring a roll during the slicing thereof, need only apply that much pressure necessary to hold the roll somewhat stationarily during slicing. Another advantage is that brace 30 may easily. and simply be placed in and out of its position of engagement with the roll, thereby facilitating a roll or bun slicing operation.

A slicing apparatus usable to slice different thicknesses of bread, rolls, and like food articles, and in which a roll or bagel may be anchored firmly, for cutting, has been disclosed. Various modifications and changes may be made without departing from the spirit of the invention.

It is claimed and desired to secure by Letters Patent:

1. Apparatus usable in slicing food articles, comprising an elongate cutting board having an upper surface on which an article to be sliced is supported, means mounted on said board defining a pair of laterally spaced guide slots for guiding a cutting blade in a planar region which extends at least to said surface and is substantially perpendicular thereto, a support member mountable on said board, with a first substantially planar face thereof confronting, and being spaced from and substantially parallel to said planar region, for supporting against said face one side of an article to be sliced, an elongate brace adapted to be supported at one of its end edges on said board, and to contact, at its other end edge, a portion of the other side of an article whose one side is supported against said support member, with the brace being inclined between said board and said article, and notch means extending laterally of said board for removably receiving the brace's said one end edge pivotally therein, to hold the same a fixed distance from said planar region.

2. The apparatus of claim 1, wherein said support member has first and second substantially parallel planar faces, and said apparatus further includes means for mounting said member releasably on said board at one position therealong in a first orientation wherein said first face confronts, is substantially parallel to, and is spaced a first distance from said region, and a second orientation wherein said second face confronts, is substantially parallel to, and is spaced a second, different distance from said region.

3. The apparatus of claim 1, wherein the brace's other end edge includes means for anchoring said other article side, when a downward force is applied to said brace in its inclined position, to stabilize the article during slicing.

4. Apparatus usable in slicing food articles, comprising an elongate cutting board having an upper surface on which an article to be sliced is supported, a pair of laterally spaced side walls mounted on said board for receiving such a supported article therebetween, said walls having formed therein a pair of upright, laterally spaced guide slots for guiding a cutting blade in a planar region which extends at least to said surface and is substantially perpendicular thereto, a support member having first and second parallel planar faces, means for mounting said member releasably on said board, at one position therealong, in a first orientation wherein said first face confronts, is substantially parallel to, and is spaced a first distance from said region, and a second orientation wherein said second face confronts, is substantially parallel to, and is spaced a second different distance from said region, said faces, when said member is mounted in said first and second orientations, serving to support thereagainst a side of an article at such first and second distances, respectively, from said planar region, an elongate brace adapted to be supported at one of its end edges on said board, and to contact, at its other end edge, a portion of the other side of an article whose one side is supported against a selected face of said member, with the brace being inclined between said board and said article, wherein application of a downward force to said brace, adjacent the article, serves to anchor the same between said brace and said wall member, and notch means formed in said board and extending laterally thereof for releasably receiving the brace's said one end edge pivotally therein, to hold the same a fixed distance from said planar region.

* * * * *